United States Patent [19]

Hall et al.

[11] 4,330,419

[45] May 18, 1982

[54] METHOD OF AND SOLVENT FOR REMOVING INORGANIC FLUORIDE DEPOSITS

[75] Inventors: Bobby E. Hall, Duncan; Michael L. Walker, Marlow, both of Okla.

[73] Assignee: Halliburton Company, Duncan, Okla.

[21] Appl. No.: 198,338

[22] Filed: Oct. 20, 1980

[51] Int. Cl.[3] ..... C23G 1/02; E21B 43/27

[52] U.S. Cl. ..... 252/8.55 B; 134/41; 252/8.55 C; 252/87; 252/136; 252/363.5

[58] Field of Search ..... 252/8.55 B, 8.55 C, 252/87, 136, 363.5; 134/41

[56] References Cited

U.S. PATENT DOCUMENTS

| | | | |
|---|---|---|---|
| 2,024,718 | 12/1935 | Chamberlain | 252/8.55 |
| 2,300,393 | 11/1942 | Ayers | 252/8.55 |
| 2,961,355 | 11/1960 | Beale et al. | 134/27 |

*Primary Examiner*—Herbert B. Guynn

*Attorney, Agent, or Firm*—Thomas R. Weaver; John H. Tregoning

[57] ABSTRACT

A composition for dissolving insoluble fluoride deposits and methods of treating subterranean formations and industrial vessels using such solution to remove fluoride deposits. The solvent comprises boric acid, methanol and hydrochloric acid.

10 Claims, No Drawings

METHOD OF AND SOLVENT FOR REMOVING INORGANIC FLUORIDE DEPOSITS

This invention relates generally to a solvent for and a method of removing undesirable inorganic fluorides scales, deposits, and the like from industrial processing units and subterranean formations.

Deposits of insoluble inorganic fluorides frequently form in confining vessels in which a fluoride-containing fluid circulates and also in subterranean formations. These deposits are generally undesirable because they can cause clogging and/or reduced flow in the water system or earthen formations wherever they occur.

In a number of industrial operations, fluids composed of or containing fluoride compounds are employed wherein such fluids contact valves and surfaces of vessels, pipes and other equipment. These fluoride-containing compounds form thermally insulating obstructing deposits or scales which interfere with the passageways of the system.

The composition of the deposit varies according to the temperature and inherent properties of the circulating fluid, the materials contained in the circulating fluid, and the shape and the composition of the contracting surfaces of the container.

Various methods have been developed for increasing the productivity of oil, gas and water wells. One method used for accomplishing this result is to place acid in contact with a formation and after the acid has dissolved the acid soluble material contained in the formation, the spent acid is withdrawn.

It is well known that hydrofluoric acid rapidly dissolves silica, clay and mixtures of silica and clay. This knowledge has been utilized in the treatment of subterranean formations containing silica and clay to increase the permeability of such formations whereby the ability of fluids, such as oil, gas and water, to flow through the thus treated formations is enhanced. This practice, known in the relevant art as sandstone acidizing, involves the use of hydrofluoric acid, sometimes in combination with and sometimes in series with other acids, to treat subterranean formations principally comprised of silica and clay.

However, it has been observed that undesirable additional reactions take place when the hydrofluoric acid contacts metallic ions such as sodium, potassium, calcium, magnesium and others which are present in the formation being treated. For example, in treating formations containing calcium or magnesium ions, a secondary deposition of calcium or magnesium fluoride may result. The reactions are represented by the following equations:

$$Ca^{++}+2F^{-}\rightarrow CaF_2 \text{ (Insoluble)}$$

$$Mg^{++}+2F^{-}\rightarrow MgF_2 \text{ (Insoluble)}$$

The metallic ions may be present in a particular formation as a result of water contained in the formation reacting with limestone, dolomite, and other metallic salts. In addition certain types of fluids used in drilling and completing well bores contain high concentrations of calcium magnesium, sodium, potassium, and other metallic ions.

The formation of the above described insoluble or partially insoluble precipitates in the treated formation may severely damage the formation and decrease the permeability thereof.

Consequently, in an effort to overcome these problems, various solvents have been developed in an attempt to dissolve the undesirable insoluble fluoride deposits. One solvent and method for removing insoluble fluoride deposits involves the use of boric acid and hydrochloric acid and is disclosed in U.S. Pat. No. 2,961,355. However, due to the poor solubility of boric acid in hydrochloric acid, the mixture of boric acid and hydrochloric acid has not been particularly effective in dissolving the unwanted insoluble fluoride compounds.

For instance, it has been found that a maximum of 2% boric acid by weight dissolves in 15% by weight of hydrochloric acid at 72° F.

The reaction which occurs to dissolve the insoluble calcium fluoride when the solvent consists of an aqueous solution of $H_3BO_3$ and HCl is thought to be:

$$nHCl+(n/2)CaF_2+H_3BO_3\rightarrow B(OH)_{4-n}F_n+(n/2)CaCl_2+H^{+}+(n-1)H_2O$$

where n has a value from about 1 to about 4.

In another words, 4 moles of HCl and 1 mole of $H_3BO_3$ are required to react with 2 moles of $CaF_2$ in order to form water-soluble products.

Therefore, the formation of the desirable water-soluble products is directly proportional to the amount of boric acid contained in the solvent.

It has been surprisingly found that the solubility of boric acid can be greatly increased by first dissolving the boric acid in methanol prior to adding hydrochloric acid to the boric acid.

The invention, therefore, comprises an improved solvent composition for inorganic fluorides and a method of removing inorganic fluoride deposits by the use of the solvent.

The composition of this invention comprises boric acid, methanol and hydrochloric acid. A corrosion inhibitor to metal attack by the acid is preferably added to the acidic solvent of the invention. The composition is prepared first by adding boric acid to methanol. Methanol is added to the boric acid to make a solution of boric acid and methanol with a ratio of 2 grams of boric acid for every 100 cc. of solution. This operation is carried out at a temperature at about 72° F. The above described mixture is added to water. Hydrochloric acid is then added to the mixture. Preferably, the final mixture contains about 15% hydrochloric acid, 4% boric acid and 20% methanol.

When the solvent is used to remove fluoride containing scale from lines or vessels, the method utilized herein comprises contacting the scale containing surfaces of the lines or vessels with the composition; heating the solvent thus in contact with the scale to a temperature between 70° to 200° F. for about 2 to 20 hours or until an appreciable percentage of the scale is dissolved; and draining and flushing the lines or vessels with water. The lines or vessels are thereafter preferably filled with dilute alkaline solution which is drained from the lines or vessels.

When the solvent is used for removing fluoride containing material in a subterranean formation, the solvent at a temperature from about 70° F. to about 600° F. is introduced into the formation and is allowed to remain in contact therewith for a time in the range from about 1 to 120 hours, or until an appreciable percentage of the fluoride compounds is dissolved. The solvent is then withdrawn from the formation.

The solvent can be utilized during many phases of oil well production. For instance, it can be injected into the well to dissolve unwanted $CaF_2$ or it can be used prior to the injection of hydrofluoric acid and mixtures thereof into the well or after the injection of hydrofluoric acid and mixtures thereof into the well. Generally, its utilization is based on the composition of the rocks in the formation.

The invention is further exemplified by the examples below and are presented to illustrate certain specific embodiments of this invention, but are not intended to be construed so as to be restrictive of the spirit and scope thereof.

EXAMPLE 1

25 ml. solvent compositions containing varius percentages of methanol, hydrochloric acid and boric acid were prepared in order to determine the solubility of calcium fluoride in the compositions.

The solubility tests were conducted by placing 25 cc. of solvent in a plastic screw lid bottle. Excess calcium fluoride was added to bottle and the mixture was shaken for 24 hours at 72° F. with a wrist arm shaker.

The mixture was then filtered and the liquid portion of the mixture was analyzed for the calcium ion concentration by standard atomic absorption techniques.

The solvent was prepared by adding a sufficient amount of methanol to 20 grams of boric acid in order to achieve a total volume of 100 ml. of methanol and boric acid. Water was added in varying amounts depending on the final hydrochloric acid, methanol and boric acid percentages desired. Various amounts of the above described mixture were pipetted into an aqueous solution of hydrochloric acid in order to achieve the desired amounts of boric acid in the solvent.

The calcium fluoride to be dissolved was subjected to the action of the solvent for 24 hours at 72° C.

Test Numbers 1, 4 and 7 were employed in order to show the solubility of $CaF_2$ without all the constituents of the solution.

Test Numbers 7, 8 and 9 were run in order to show the effects of increased amounts of boric acid with the dissolving of $CaF_2$.

The preferred order of mixing of the solvent is adding to the methanol-boric acid mixture, water followed by the hydrochloric acid. However, acceptable results can be achieved by adding hydrochloric acid to the methanol-boric acid mixture prior to the addition of the water.

The results appear on Table I.

TABLE I

| Test Number | HCl (Wt. %) | Methanol (Vol. %) | Percent $H_3BO_3$ (Wt. %) | Calcium Fluoride Dissolved (g/l) |
|---|---|---|---|---|
| 1. | 0 | 20 | 2 | 0.02 |
| 2. | 7.5 | 20 | 2 | 38.0 |
| 3. | 15 | 20 | 2 | 43.7 |
| 4. | 15 | 0 | 2 | 45.6 |
| 5. | 15 | 10 | 2 | 43.9 |
| 6. | 15 | 20 | 2 | 42.7 |
| 7. | 15 | 20 | 0 | 4.7 |
| 8. | 15 | 20 | 2 | 41.9 |
| 9. | 15 | 20 | 4 | 83.5 |

Referring to Table I, the data in this Table show that increasing the hydrochloric and boric acid concentrations improve the solubility of calcium fluoride significantly, but merely increasing the methanol concentration will apparently slightly decrease the solubility of calcium fluoride.

EXAMPLE 2

To show the solubility of magnesium fluoride in the solvent of the invention, magnesium fluoride shown in Table II, was placed in a solution containing 15 percent hydrochloric acid and various amounts of boric acid and methanol. The solvent containing boric acid, methanol and hydrochloric acid was prepared in the same manner as Example 1. The magnesium fluoride to be dissolved was subjected to the action of the solvent of the invention for 24 hours at 72° F.

The results appear in Table II.

TABLE II

| Test Number | $H_3BO_3$ (g/100 cc) | Methanol (V/V %) | Magnesium Fluoride Dissolved (g/l) |
|---|---|---|---|
| 1 | 0.0 | 0.0 | 15.2 |
| 2 | 2.15 | 10 | 37.5 |
| 3 | 4.30 | 20 | 60.2 |

Referring to Table II, it can be seen that the solvent system containing hydrochloric acid, methanol and boric acid effectively dissolved the insoluble magnesium fluoride and the solvent containing 20% methanol along with 4.3 grams of boric acid had the greatest effect on dissolving the magnesium fluoride.

In carrying out the invention, the concentration of the hydrochloric acid may vary rather widely. It has been found that from 5 to 30 percent by weight of hydrochloric may be used with about 10 to 20 percent by weight being preferred. However, about 15% hydrochloric is recommended. The amount of methanol recommended for carrying out this invention can vary from about 10 to about 20 percent by weight. However, about 20% methanol is recommended.

The amount of boric acid recommended for carrying out the invention is about 4 to 5 percent by weight. From the different tables, it can be seen that a far greater amount of calcium fluoride dissolves at 4% to 5% than at the lower concentrations of boric acid. However, amounts of from about 2 to 5 percent by weight may be used.

In particularly thick deposits of the insoluble fluoride, the process may be repeated for best results.

Although the solvent of the invention may be used without a corrosion inhibitor, the presence of a acid corrosion inhibitor is preferred. The presence of known acid corrosion inhibitors in no way interferes with the effectiveness of the solvent of the invention. Corrosion inhibitors such as inorganic arsenic compounds, acetylenic alcohols, thiophenols, heterocyclic nitrogen compounds, substituted thiophenols, rosin amine derivatives, quaternary ammonium compounds and other similar agents may be employed. A particularly suitable corrosion inhibitor for use with the acid treating compositions of the present invention is a mixture of propargyl alcohol, alkyl pyridine, methyl formcel, diacetone alcohol and ethyl octynol.

The invention is not limited to the above described specific embodiments thereof; it must be understood therefore, that the detail involved in the descriptions of the specific embodiments is presented for the purpose of illustration only, and that reasonable variations and modifications, which will be apparent to those skilled in the art, can be made in this invention without departing from the spirit and scope thereof.

What is claimed is:

1. A composition for dissolving insoluble fluoride deposits comprising:
   (a) from about 5 to about 30% by weight of hydrochloric acid;
   (b) from about 10 to about 20% by weight of methanol; and
   (c) from about 2 to about 5% by weight of boric acid, said methanol and said boric acid having been premixed before being mixed with said hydrochloric acid.

2. The composition as recited in claim 1, further comprising an inhibitor to acidic corrosion of metal.

3. The composition as recited in claim 1, wherein the hydrochloric acid ranges from about 10 to 20 percent by weight.

4. The composition as recited in claim 3 further comprising an inhibitor to acidic corrosion of metal.

5. A method of removing insoluble fluoride material from a subterranean formation comprising:
   (a) introducing into said formation a composition comprising from about 5 to about 30% by weight of hydrochloric acid, from about 10 to about 20% by weight of methanol and from about 2 to about 5% by weight of boric acid, said methanol and said boric acid having been premixed before being mixed with said hydrochloric acid.
   (b) allowing said composition to remain in said formation; and,
   (c) withdrawing said composition from said subterranean formation.

6. A method of removing insoluble fluorine containing deposits from a metal surface comprising:
   (a) contacting said surface to the action of a composition comprising from about 5 to about 30% by weight of hydrochloric acid, from about 10 to about 20% by weight of methanol and from about 2 to about 5% by weight of boric acid, said methanol and said boric acid having been premixed before being mixed with said hydrochloric acid;
   (b) allowing said composition to remain in contact with said surface; and
   (c) removing said composition from said surface.

7. The method of claim 5, wherein said hydrochloric acid ranges from about 10 to 20 percent by weight.

8. The method of claim 6, wherein said hydrochloric acid ranges from about 10 to 20 percent by weight.

9. The method of claim 5 or 6, wherein said composition contains an inhibitor to acid corrosion of metal.

10. The method of claim 7 or 8, wherein said composition contains an inhibitor to acid corrosion of metal.

* * * * *